US005337703A

United States Patent [19]

Schlesch et al.

[11] Patent Number: 5,337,703

[45] Date of Patent: Aug. 16, 1994

[54] STEAM GENERATOR

[75] Inventors: Ronald D. Schlesch, Stuart, Fla.; Rex B. Cheskaty, Kalamazoo, Mich.

[73] Assignees: Trouvay & Cauvin, Asnieres, France; Armstrong International, Inc., Three Rivers, Mich.

[21] Appl. No.: 91,345

[22] Filed: Jul. 14, 1993

[51] Int. Cl.[5] ..... F22B 37/18; F22B 37/48

[52] U.S. Cl. ..... 122/379; 122/398; 162/146; 210/175; 210/496; 392/386; 392/387; 392/394

[58] Field of Search ..... 122/379, 397, 398; 162/146; 210/175, 496; 312/31.1; 261/DIG. 33, DIG. 65; 392/386, 387, 394, 403; 134/105

[56] References Cited

U.S. PATENT DOCUMENTS

| | | | |
|---|---|---|---|
| 1,883,856 | 10/1932 | Ostertag | 122/398 |
| 1,994,331 | 3/1935 | Ziskin et al. . | |
| 2,933,460 | 4/1960 | Richter, Jr. et al. . | |
| 3,136,829 | 6/1964 | Skerritt . | |
| 3,188,061 | 6/1965 | Alguire . | |
| 3,386,711 | 6/1968 | Williams . | |
| 3,476,673 | 11/1969 | Stiles . | |
| 3,481,588 | 12/1969 | Lobb . | |
| 3,688,083 | 8/1972 | Rice et al. . | |
| 3,776,530 | 12/1973 | Griffith et al. . | |
| 4,007,114 | 2/1977 | Ostreicher . | |
| 4,146,775 | 3/1979 | Kirchner et al. . | |
| 4,157,963 | 6/1979 | Jessop et al. . | |
| 4,222,971 | 9/1980 | Eilert . | |
| 4,257,989 | 3/1981 | Nishikawa . | |
| 4,631,135 | 12/1986 | Duddridge et al. . | |
| 4,638,766 | 1/1987 | Bunch et al. | 122/398 |
| 4,675,505 | 6/1987 | Fischer . | |
| 4,705,936 | 11/1987 | Fowler . | |
| 4,973,382 | 11/1990 | Kinn et al. | 162/146 |
| 5,060,686 | 10/1991 | Troy . | |
| 5,088,518 | 2/1992 | Stamatakis et al. . | |

FOREIGN PATENT DOCUMENTS

| | | |
|---|---|---|
| 0240387 | 10/1987 | European Pat. Off. . |
| 715344 | 12/1941 | Fed. Rep. of Germany . |
| 2094930 | 2/1972 | France . |
| 2420731 | 10/1979 | France . |
| 2236687 | 4/1991 | United Kingdom . |

OTHER PUBLICATIONS

Filtermat Type P15/150S, P15/350S, P15/500S, Data Sheet, Freudenberg Nonwovens L.P., Viledon Filter Division, 1 page.

*Primary Examiner*—Edward G. Favors

*Attorney, Agent, or Firm*—Flynn, Thiel, Boutell & Tanis

[57] ABSTRACT

Mineral salts formed during steam generation are preferentially deposited on one or more non-woven, porous mats made of fiber-forming synthetic resin.

9 Claims, 12 Drawing Sheets

STEAM GENERATOR

FIELD OF THE INVENTION

This invention relates to a steam generator, especially for use in a high capacity humidification system suitable for industrial, commercial, hospital and other relatively large size installations. Maintenance requirements are reduced by minimizing the build-up of mineral deposits on the surfaces of the evaporation tank and, instead, causing such build-up to occur preferentially on porous mats which can easily be replaced or cleaned.

BACKGROUND OF THE INVENTION

It is well-known to use humidifying systems which employ steam generators. The boiling of the supply water to generate steam is advantageous because bacteria present in the supply water are killed and minerals present in the supply water tend to remain in the evaporation tank. Thus, the steam fed into the heating, ventilating and air conditioning system is clean and sterile.

The supply water in such devices is the usual local supply water which invariably contains insoluble mineral salts, such as calcium carbonate. Thus, over time, deposits of dirt, dust, lime and other minerals accumulate on various interior surfaces of the steam generator, including the heat exchange surfaces and walls of the evaporation tank. This reduces the efficiency of energy transfer from the heat source to the water. Frequent removal of accumulated, adhering, mineral deposits is required. The task of removing accumulated mineral deposits is at least bothersome and it may be quite difficult.

It has been suggested to drain periodically some of the water in the evaporating tank in order to reduce the build-up of mineral concentration therein. This is not fully satisfactory because a relatively large quantity of water is circulated through and is discarded from the evaporation tank during operation. This mode of operation is unsuited for areas where water conservation is desireable. Moreover, the additional tanks, pipes, valves, etc. that are required increase the cost of the installation and, over time, mineral deposits may adhere to them and require cleaning.

SUMMARY OF THE INVENTION

According to the present invention, the amount of minerals and other solids deposited on internal surfaces of the evaporation tank of a steam generator, including heat exchange surfaces thereof, is reduced by contacting the water in the evaporation tank with one or more porous, non-woven, fibrous mat(s) having a high surface area. The mat(s) are made of fibers of synthetic fiber-forming resin. The mat(s) are effective to cause the minerals to deposit on the mat(s) in preference to other internal surfaces of the evaporating tank, especially heat exchange surfaces thereof. More particularly, the mat(s) are non-woven, porous, textile-like materials in flat sheet form. The mat(s) have a high ratio of void volume to surface volume and have interconnected interstices or voids. The mat(s) are composed of water-insoluble fibers assembled in webs of long single filaments arranged randomly. The filaments have a diameter or fiber size of from about 0.1 to 45 denier. The mat(s) have a basis weight (weight per unit area) of about 10 to 800 g/m$^2$, preferably about 17–180 g/m$^2$. The mat(s) have planar-isotropic or non-directional properties owing to the random lay down of the filaments. The filaments are thermally bonded to each other where they contact by fiber-to-fiber fusion. The bond-to-bond distances are from about 50 to 100 times the filament diameter. The mat(s) preferably are compressible. The fibers typically have a length of from about 1.2 to 200 cm. It is preferred that the mat(s) are spun-bonded mat(s) consisting essentially of randomly distributed, polyester fibers, preferably polyethylene terephthalate fibers, which are thermally bonded to each other at the locations where they contact each other.

In use, the mineral deposits form substantially cylindrical, sheath-like coatings of crystalline mineral particles on the surfaces of each of the individual synthetic resin fibers of the mat(s), that is, each fiber forms the central core and the fine mineral crystals form a cylindrical sheath encircling the core. This is shown in FIG. 8, which is a photograph, at 60 magnifications, of two fibers of a mat of a steam generator which was operated for 980 hours using the local water supply of the city of Three Rivers, Michigan. In FIG. 8, fragmentary portions of the mineral coating on the fibers were broken off to expose portions of the core fibers. FIG. 9 is a photograph at 10 magnifications, of a fragment of the mat. In the mat of FIGS. 8 and 9, the individual fibers of the mat had a diameter of about 0.001 inch. The cylindrical mineral-coatings on the individual fibers had a diameter of about 0.013 inch. The outer diameters of the mineral coatings on the fibers progressively increase as time passes during operation of the humidifier. The exposed surface areas of the coated fibers also progressively increase as more crystalline deposits adhere thereto and this is effective to increase further the amount of minerals that are deposited on the fibers whereby the collection efficiency of the mat(s) improve(s). Eventually, however, the fibers become so heavily encrusted with mineral deposits that the interstices or spaces between the fibers are nearly filled up. This then reduces the total surface area on which additional mineral deposits can form and, thus, reduces the collection efficiency of the mat(s). The original mat(s) can then be replaced by new mat(s), or the original mat(s) can be cleaned, so that the process can be continued. Because of the high collection efficiency of the mat(s), a very high percentage, usually about 90%, of the minerals in the supply water are deposited preferentially on the mat(s). The amounts of solids that are deposited on other surfaces of the evaporation tank, especially heat exchange surfaces thereof, are quite small and are much less than the amounts that are deposited thereon when the mat(s) are not used.

The mat(s) do not perform merely a filtering or mechanical straining or screening of the solids that are created by the generation of steam in the evaporation tank. This is shown by the fact that the individual mineral particles thus formed are smaller than the interstices in the mat(s) and would pass therethrough if only mechanical straining or screening were involved. The inventors have not, to date, fully clarified the mechanism by which the minerals preferentially deposit in the form of individual thick sheaths or coatings on the individual fibers of the mat(s). At present, the inventors believe that the mechanism is substantially as described in the following explanation. The invention, however, is not limited to the correctness of this explanation. According to this explanation the mineral particles that form in the evaporation tank during steam generation are attracted to the fibers of the mat(s) because the zeta potential of the fibers is higher than the zeta potentials of the surrounding evaporation chamber surfaces and the heating elements. Once attracted to the fibers, the mineral particles are retained thereon by van der Waal's forces. This explanation is related to the mechanism described in U.S. Pat. No. 4 007 114. However, unlike No. 4 007 114, this invention does not require surface treatment of the fibers to introduce cationic groups therein.

Other possible explanations for the preferential deposition of mineral particles on the fibers are that the mineral particles flocculate by interparticle bridging and/or the fibers provide nucleation sites on which the crystalline deposits can form as they crystallize out of solution during steam generation in the evaporation tank.

An apparatus, according to the invention, comprises a housing having an opening through one wall thereof. A drawer is movably disposed in the opening so that it can be moved between an open position outside the housing and a closed position in which it sealingly engages the housing so that steam that can be generated therein and can be discharged therefrom only through a discharge opening. An evaporation tank is mounted on the drawer for movement therewith. When the drawer is in the closed position, the evaporation tank is disposed inside the housing so that steam can be generated therein and thence fed through the discharge opening into the ductwork of the heating, ventilation and air conditioning system, for humidification purposes. When the drawer is open, the interior of the evaporation tank is exposed. The evaporation tank can be heated by internal or external heating means of any desired type, for example as listed thereafter. It is preferred, however, to use an internal electric resistance heating unit in order to boil the water in the evaporation tank. One or more of the non-woven, fibrous mats, described above, is (are) removably disposed inside the evaporation tank so as to be substantially completely immersed in the water during the steam generation, thereby to cause the crystalline mineral deposits that are formed during steam generation to form preferentially on the mat(s), in preference to other internal surfaces of the evaporation tank.

Although the invention does not entirely eliminate the problems of mineral deposits in steam generators, it does reduce the severity of the problems and makes possible a more easily manageable maintenance procedure because the replacement of the mat(s) is similar to replacing a furnace filter in a conventional household, forced hot-air, heating system.

Accordingly, it is an object of the invention to provide an inexpensive, disposable mat in a steam generator, which mat is effective to remove most of the mineral deposits as they form in the evaporation tank during steam generation, whereby to reduce the amount of such mineral deposits that form on other internal surfaces of the evaporation tank.

Another object of the invention is to provide a steam generator having a mat or mats, as aforesaid, which do not interfere with the operation of the steam generator.

A further object of the invention is to provide a steam generator having a mat or mats, as aforesaid, in which the evaporation tank can be moved between a closed position for effecting steam generation and an open position in which the mat or mat(s) is(are) exposed for easy removal and replacement by fresh mat(s).

DETAILED DESCRIPTION OF THE INVENTION

Figure 1:
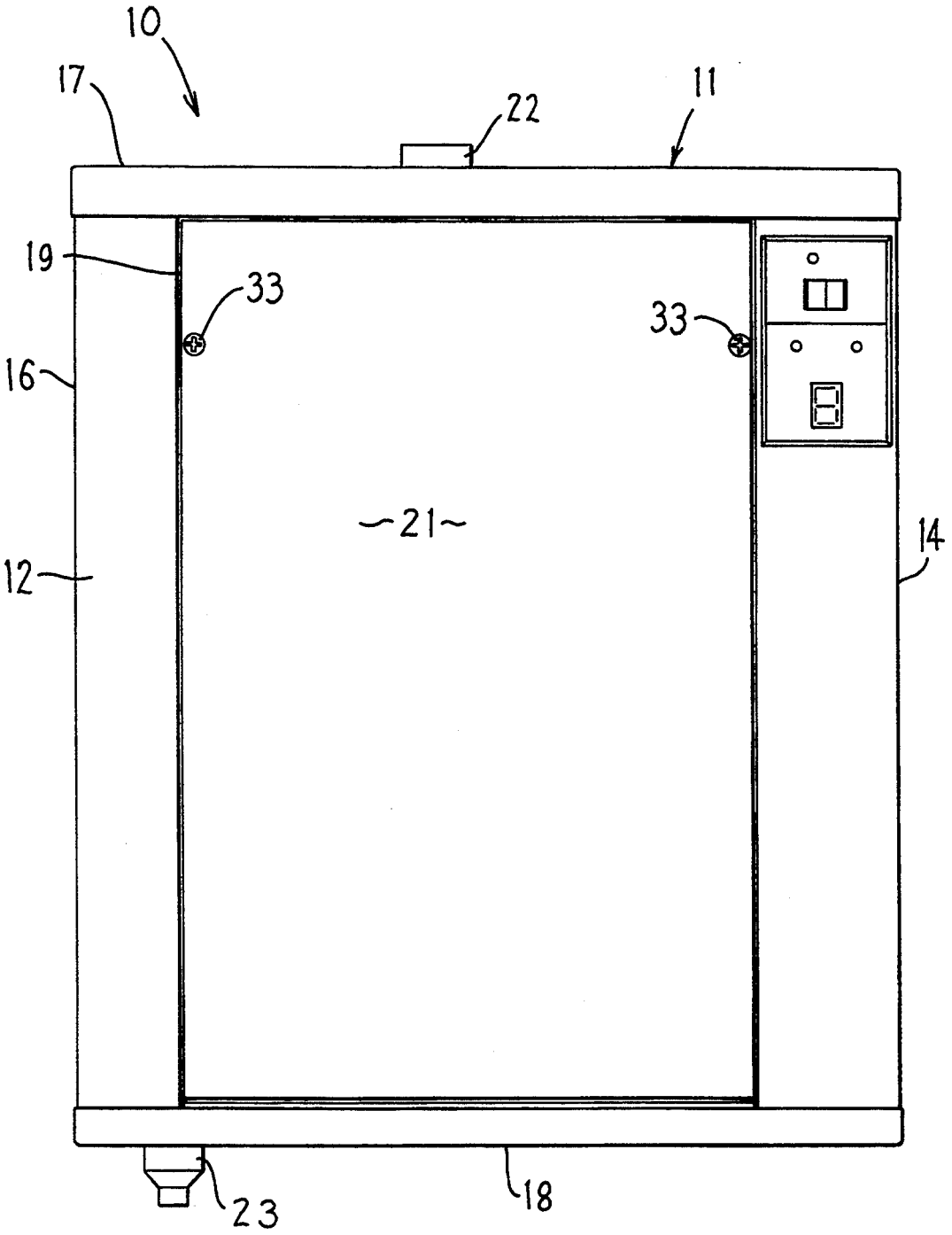
FIG. 1 is a front elevational view of a steam generation unit according to the invention.
Figure 2:
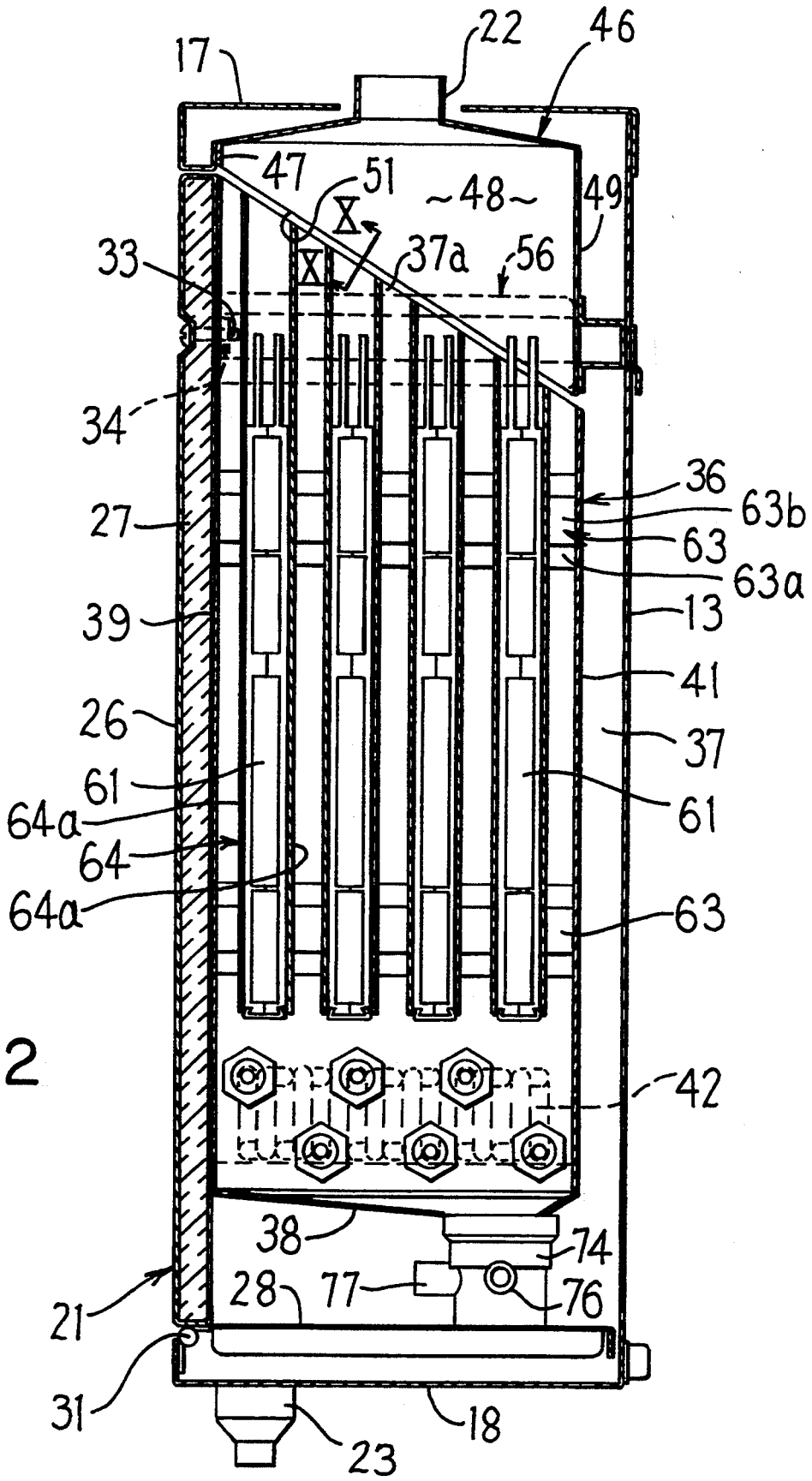
FIG. 2 is a sectional view substantially taken along the line II—II of FIG. 4.
Figure 3:
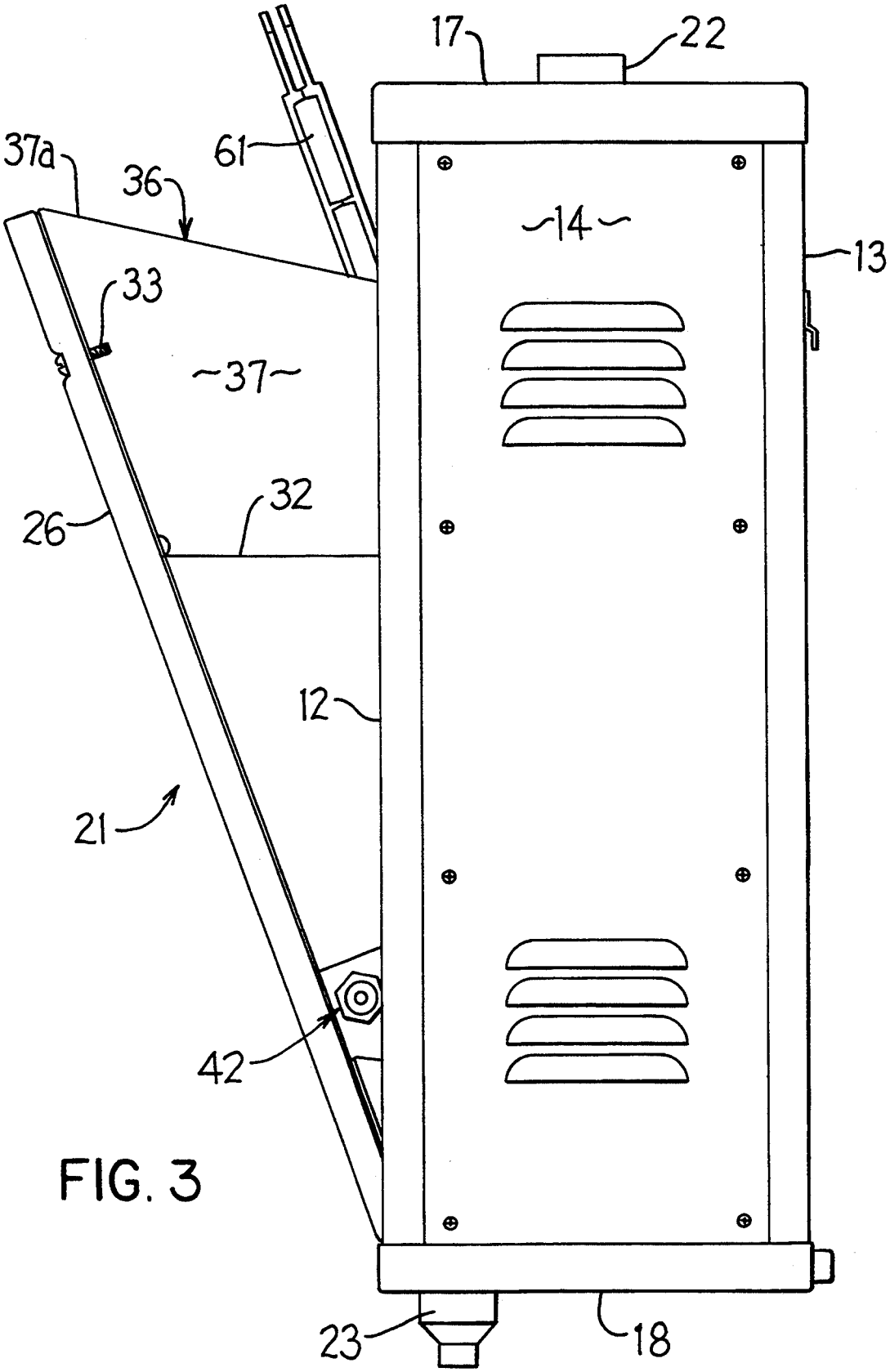
FIG. 3 is a side elevational view of the steam generation unit of FIG. 1 with the drawer in an open position and showing one of the mats partially removed from the evaporation tank.
Figure 5:
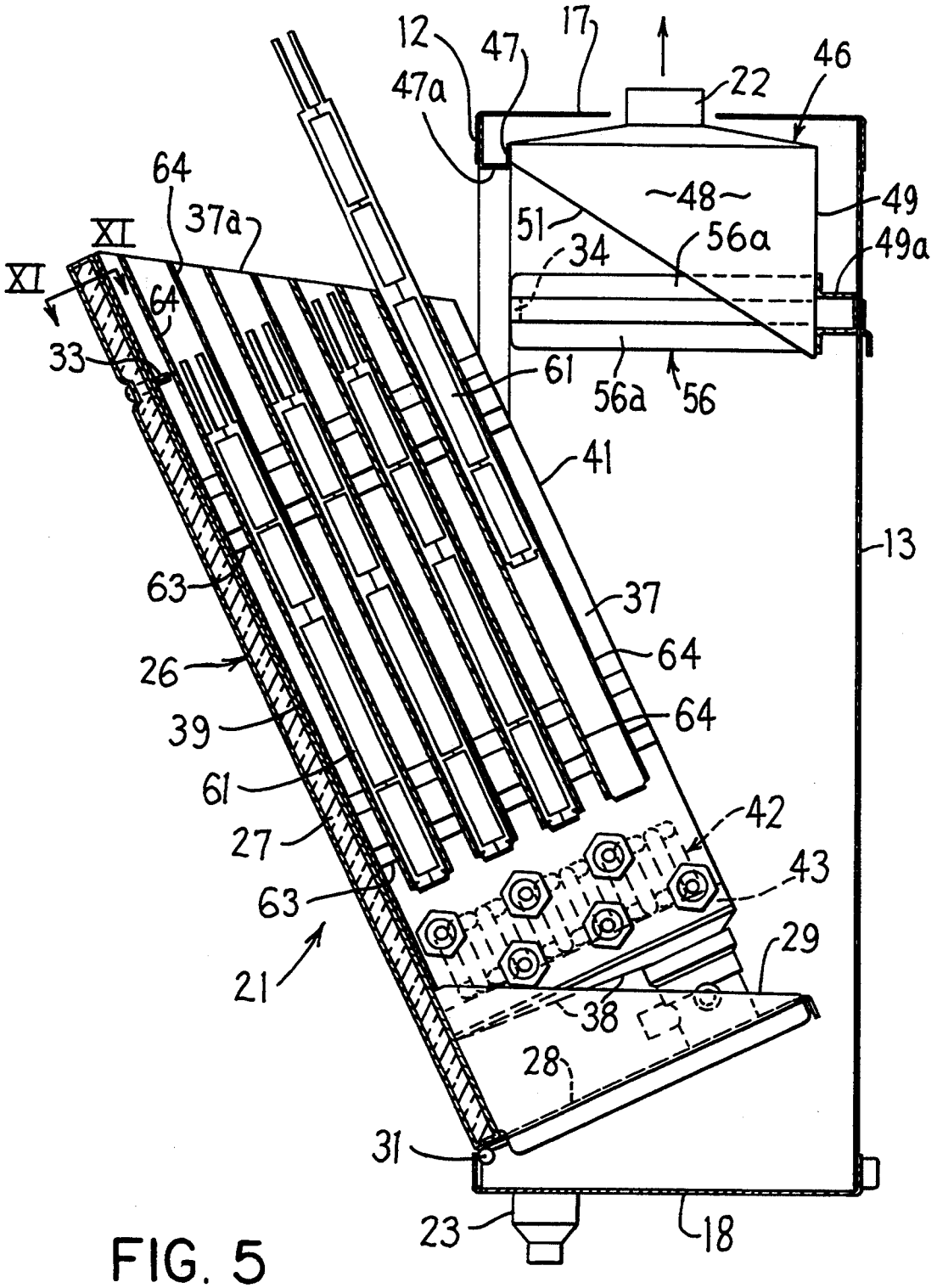
FIG. 5 is a view like FIG. 2, but substantially taken on the line V—V of FIG. 4 and showing the drawer in an open position.

Referring to the drawings, the steam generating unit is indicated generally by the reference number 10 (FIGS. 1 and 2). The steam generating unit 10 is comprised of a shell or housing 11 having a front wall 12, a back wall 13, a pair of opposite end walls 14 and 16, a top wall 17 and a bottom wall 18. The front wall 12 has a large size, drawer opening 19 therethrough. A tilt-out drawer 21 is moveably disposed in the opening 19 for movement between a closed position (FIG. 2) and an open position (FIGS. 3 and 5). A steam discharge pipe 22 extends through the top wall 17. A drain pipe 23 extends through the bottom wall 18. The housing 11 is substantially rectangular in front elevational view (FIG. 1) and, also, in top plan view.

The tilt-out drawer 21 is comprised of a hollow front panel 26 containing a heat insulation layer 27, for example, a glass fiber mat. A shelf-like base wall 28 extends rearwardly (FIG. 2) from and is fixed to the lower edge of the front panel 26. The base wall 28 is substantially parallel with the bottom wall 18 of the housing 11 in the closed position of the drawer 21 (FIG. 2). An upright triangular gusset plate 29 is provided at one of the side edges (the right edge in FIG. 4) of the drawer 21 and is secured to and extends between the inner side of the front panel 26 and the base wall 28 for the purpose of strengthening the assembly. A horizontal hinge 31 hingedly connects the lower edge of the drawer 21 to the front wall 12 of the housing 11 at the lower edge of the drawer opening 19 so that the drawer 21 can be pivoted outwardly about a horizontal pivot axis close to its lower edge from an upright, closed position (FIG. 2) in which it closes and seals the drawer opening 19 to an upwardly and outwardly inclined, open position (FIGS. 3 and 5), in a manner similar to the way an oven door of a household cooking range can be tilted outwardly. A flexible connector 32 (FIG. 3), such as a cable or chain, is provided to limit outward tilting movement of the drawer 21.

The drawer 21 is normally releasably held in its upright, closed position by means of front facing screws 33 (FIGS. 1–3). The screws 33 are mounted on opposite side edges of the drawer 21 close to the upper edge thereof. The screws 33 are threaded into nuts 34 which are fixedly mounted at the front wall 12 of the housing 11 on opposite lateral sides of the drawer opening 19 and in alignment with the screws 33 when the drawer 21 is closed.

An open-topped evaporation tank 36 is removably mounted on the interior side of the front panel 26 of the tilt-out drawer 21. The evaporation tank 36 is comprised of two side walls 37 disposed adjacent to the opposite lateral side edges of the drawer opening 19, an inwardly sloping, funnel-like bottom wall 38, a front wall 39 and a back wall 41. The upper edges **37*a* of the two side walls 37 are angled upwardly and forwardly toward the front panel 26 to permit the tilt-out drawer 21 to be tilted outwardly as shown in FIGS. 3 and 5. The upper side of the evaporation tank 36 is open. The evaporation tank 36** is adapted to contain a supply of water to be evaporated.

Figure 4:
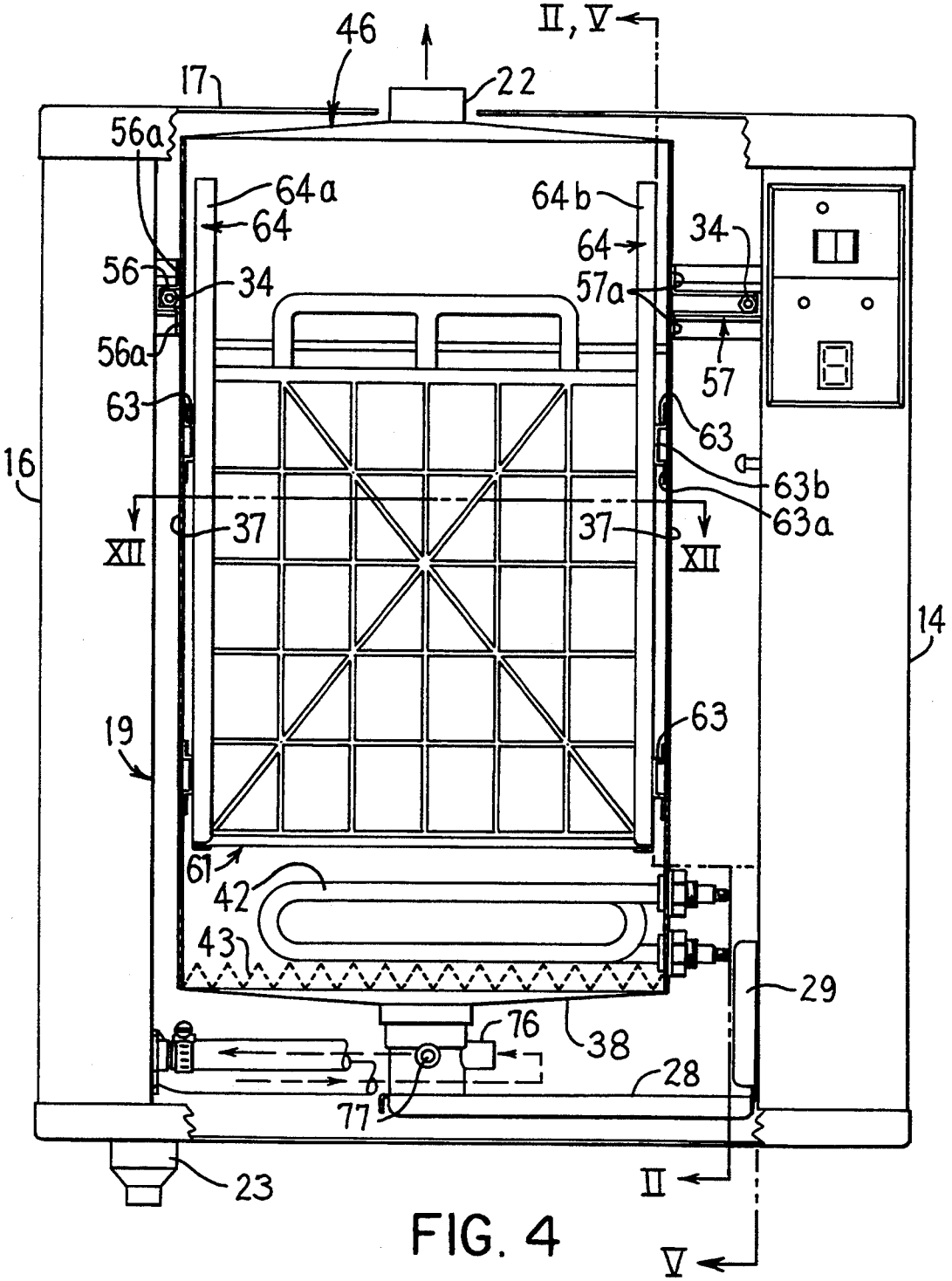
FIG. 4 is a view like FIG. 1, on an enlarged scale, with the tank front wall panel and front drawer panel removed and adjacent parts of the housing broken away.

Suitable means are provided to heat the water in the evaporation tank 36 to boiling. In the illustrated embodiment, the heating means is an electrical resistance heating unit 42 which is disposed inside the evaporation tank 36 directly above the bottom wall 38 thereof. As shown in FIG. 4, the heating unit 42 is supported on a screen 43 which rests on the bottom wall 38. The screen 43 is of saw-tooth or substantially sinuous shape in cross-section. In addition to supporting the heating unit 42, the screen 43 also screens out large particles which fall to the bottom of the evaporation tank 36 so that they do not enter the water-discharge opening described below. It is to be understood, however, that a wide variety of internal and external heating units can be employed, including boiling electrodes disposed inside the evaporation tank 36, a heat exchanger connected to a live steam supply or external burners.

A steam collection dome 46 (FIG. 5) is stationarily mounted in the upper portion of the housing 11 directly above the position occupied by the drawer 21 when said drawer is in its normal, upright, closed position (FIG. 2) inside the housing 11. The dome 46 has a front wall 47, two side walls 48 and a back wall 49, which walls correspond to and constitute vertical extensions of the front wall 39, the side walls 37 and the back wall 41 of the evaporation tank 36 when said tank is in its FIG. 2, normal, upright, closed position inside the housing 11. The dome front and back walls 47 and 49 are fixed respectively to an inturned lip **47*a* (FIG. 5) of the housing central front wall 12 and through a hat cross-section spacer 49*a* to the housing rear wall 13. The lower edges 51 of the side walls 48 are angled upwardly and outwardly (forwardly) in the same way as the upper edges 37*a* of the side walls 37 of the evaporation tank 36**.

Figure 10:
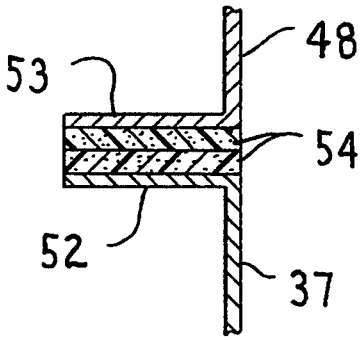
FIG. 10 is a sectional view substantially taken along the line X—X in FIG. 2 and showing a seal.
Figure 12:
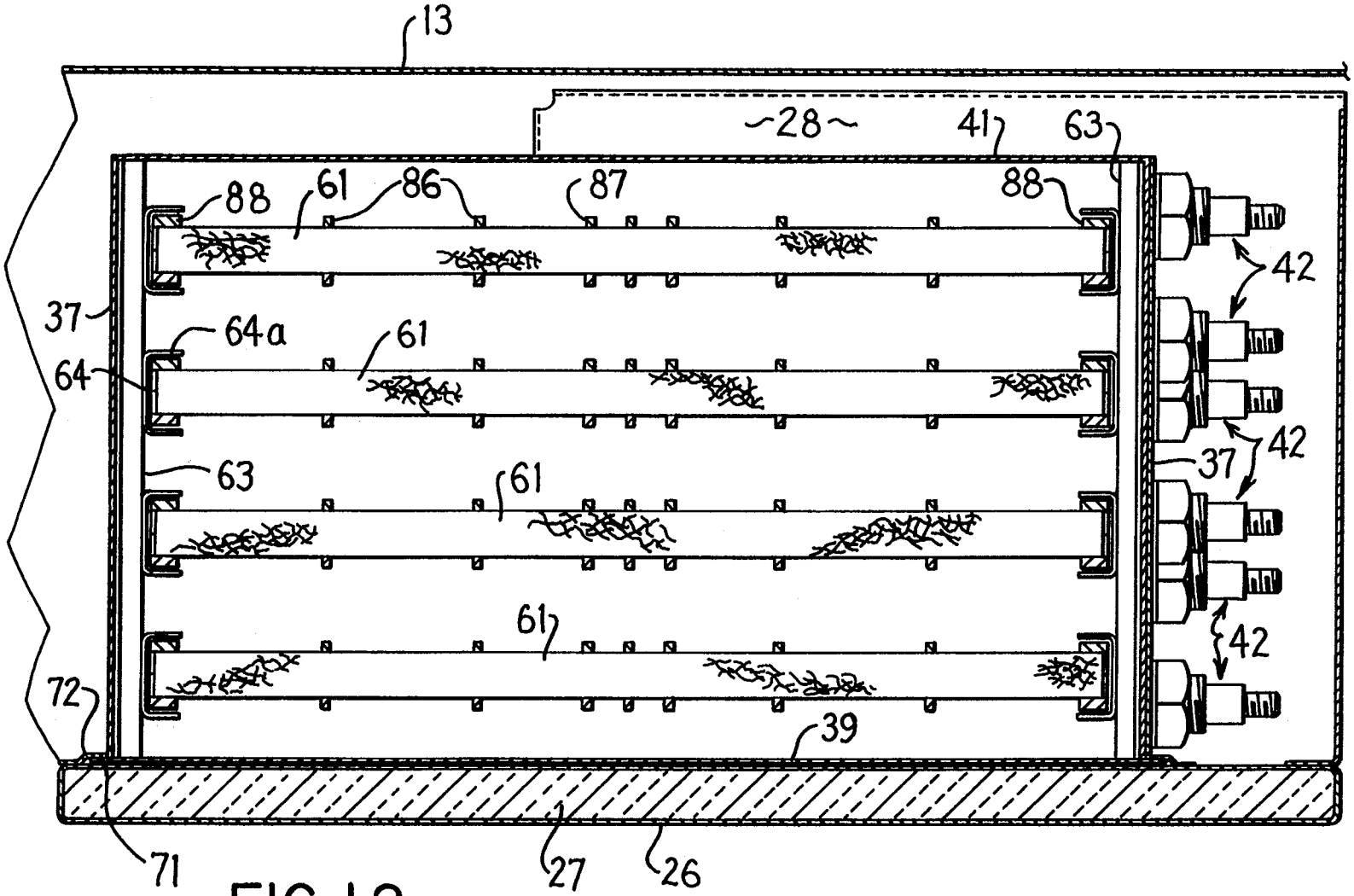
FIG. 12 is a sectional view substantially taken on the line XII—XII in FIG. 4.
Figure 13:
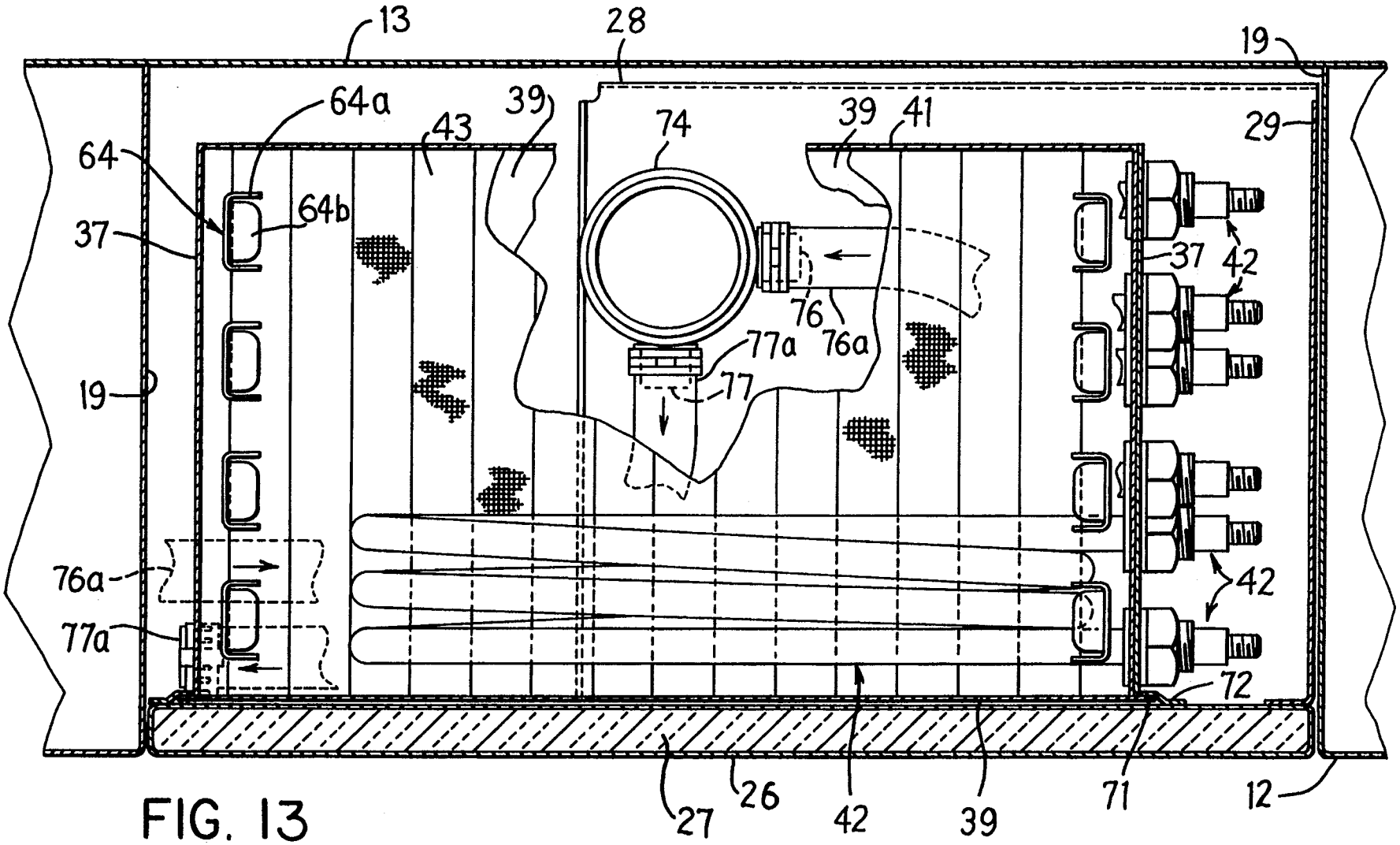
FIG. 13 is a sectional view substantially taken on the line XIII—XIII of FIG. 4A, with the screen and tank bottom wall partly broken away.

As shown in FIG. 10, the upper edges of the front, back and side walls of the evaporation tank 36 and the lower edges of the front, back and side walls of the steam collection dome 46 have inturned flanges 52 and 53 which are disposed close to, and extend substantially parallel to, each other. The opposing surfaces of the flanges 52 and 53 have sealing means, such as elastically compressible, closed cell, foam strips 54, mounted thereon, for example, by a water-resistant adhesive. When the tilt-out drawer 21 is in its normal, upright, closed position inside the housing 11 and the screws 33 are tightened, the sealing strips 54 are pressed into sealing engagement with each other to provide a steam-tight seal between the entire upper edge of the evaporation tank 36 and the entire lower edge of the steam collection dome 46.

The steam discharge pipe 22 (FIG. 2) communicates with the upper end of the steam collection dome 46 so that steam generated in the evaporation tank 36 can be discharged from the steam generating unit 10 and used for humidification purposes.

A pair of horizontal, elongated guides 56 and 57 (FIG. 4) are mounted on the inner sides of the side walls of the opening 19 of the housing 11 close to the upper end thereof. The guides 56 and 57 are hat-shaped in cross-section and have guide flanges **56*a* and 57*a* which slidably engage the outer sides of the side walls 37 of the tilt-out drawer 21 whereby to slideably engage and guide the drawer during tilting movement thereof. The nuts 34 are fixed, as by welding, inside the channels of the guides 56 and 57 at the front end thereof. The rear end portions of the guides 56 and 57 may also laterally locate the dome 46 in the housing 11**.

At least one mat 61 (FIGS. 2, 4 and 5), here a horizontal array of four upright mats 61, is disposed inside the evaporation tank 36. The mats 61 are upright and are parallel with each other and with the front wall 26 of the drawer 21 (FIG. 5). The mats 61 extend upwardly from adjacent to the heating means 42 to close to the open upper end of the evaporation tank 36.

The mats 61 are fixedly located in, but easily removable from, the evaporation tank 36. For this purpose, the inner sides of the side walls 37 of the evaporation tank 36 each have two vertically spaced-apart, horizontal, elongated guides 63 (FIGS. 2 and **4*a*) mounted thereon. The guides 63 are hat-shaped in cross-section with edge flanges 63*a* fixed on the tank sidewall 37 and a central base web 63*b* spaced from the sidewall 37. The side edges of each mat 61 are vertically slidably received in opposed vertical channels 64 each having a central web fixed to and crossing the base webs 63*b* of the adjacent guides 63 so that the mats can be slid upwardly out of and downwardly into the evaporation tank 36. Each vertical channel 64 has a pair of inwardly extending, laterally spaced-apart flanges 64*a* and a bottom flange 64*b*. The paired flanges 64*a* laterally overlap and slidably engage the front and rear surfaces the adjacent vertical edge portion of their associated mat 61 and define a vertical guide slot for laterally fixing the mat 61. The mat 61 rests on the bottom flange 64*b*. Thus, the mats 61 are removably mounted in spaced-apart, parallel relationship and are vertically slidable into and out of the evaporation tank 36. See for example the partially removed rearmost mat 61 in FIG. 5**.

Figure 11:
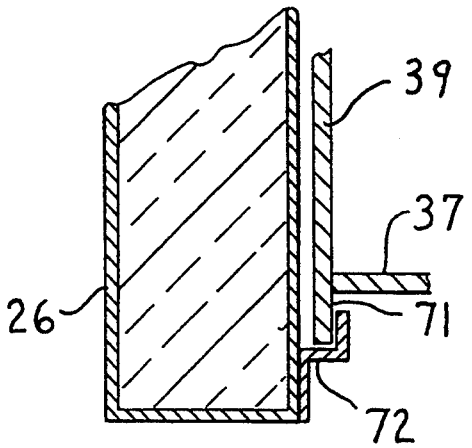
FIG. 11 is a sectional view substantially taken along the line XI—XI in FIG. 5.

As indicated above, each of the mats 61 can be individually removed from the evaporation tank 36. In addition, the entire evaporation tank 36, including the mats 61 and the heating unit 42, can be removed as a unit from the tilt-out drawer 21, for example, when it is necessary to clean or replace the heating unit 42 or to make other repairs. For this purpose, as shown in FIG. 11, the tank front wall 39 extends laterally beyond the side walls 37 of the evaporation tank 36 to form laterally outwardly extending flanges 71 which are vertically slidably receivable in laterally opposed, vertical channels defined by sinuous mounting strips 72 fixed to the inner side of the front wall 26 of the tilt-out drawer 21. Thus, the entire evaporation tank 36 can be slid vertically upwardly relative to the tilt-out drawer 21 when said drawer is in its open, outwardly tilted FIG. 5 position, in order to remove the evaporation tank.

Figure 4A:
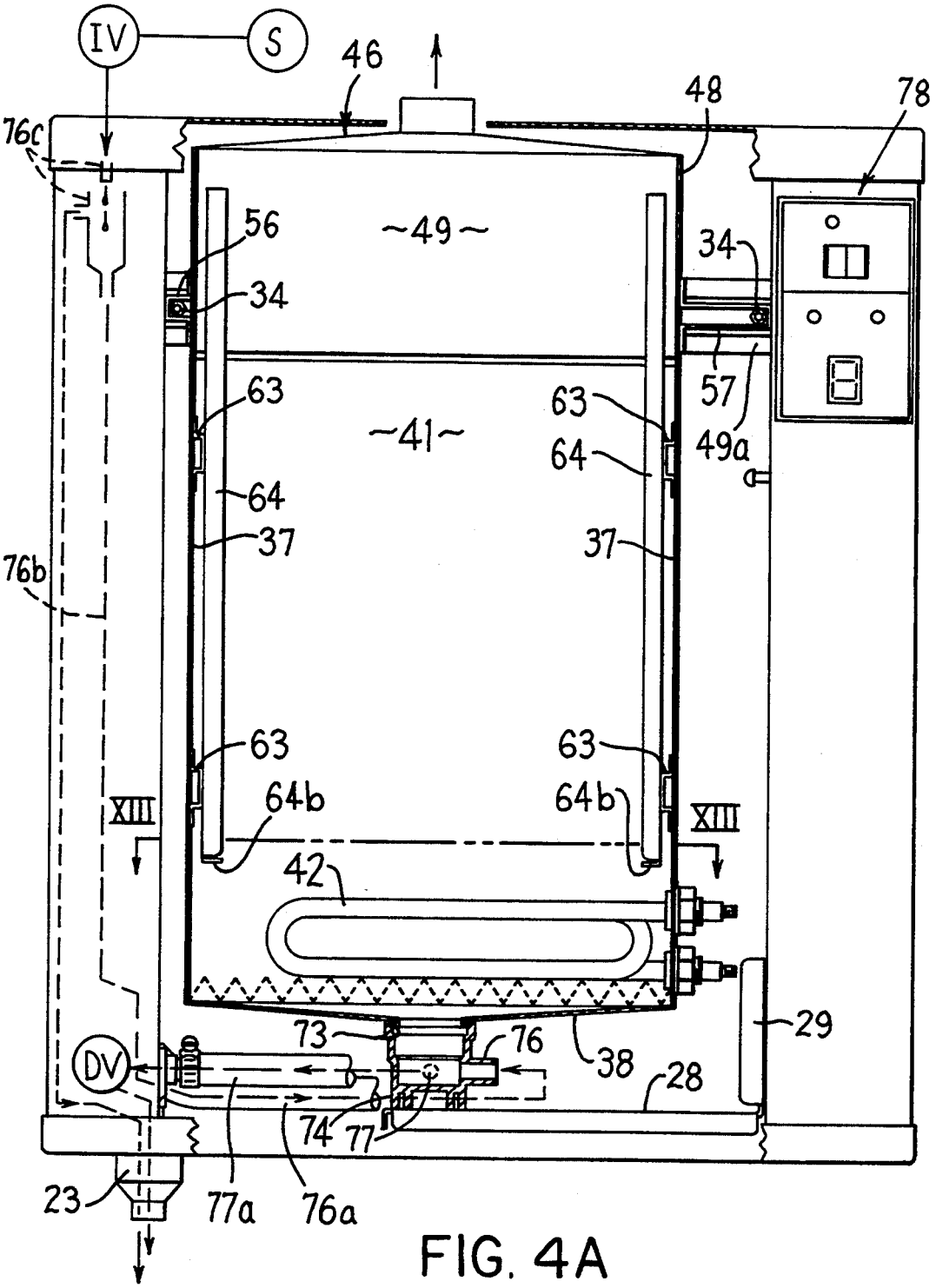
FIG. 4A is a view similar to FIG. 4 but with the mat(s) and their surrounding framework(s) removed.

Referring to FIG. 4, the lower wall 38 of the evaporation tank 36 has an inlet/outlet port and, in communication therewith, a fixed, short, downwardly extending nipple 73. The nipple 73 is vertically slidably received inside the upper end of a cup-like fixture 74 which is fixedly mounted on the base wall 28 of the tilt-out drawer 21. The fixture 74 has two ports 76 and 77. As schematically shown in FIG. 4*a*, port 77 is conventionally connected by a flexible hose 77*a* to a drain valve DV for controlling discharge of waste water from the evaporation tank. Port 76 is conventionally connected by a flexible hose 76*a*, conduit 76*b*, anti-back-siphon funnel/spigot unit 76*c*, and inlet valve IV to a water supply S for filling the evaporation tank.

Suitable conventional controls are provided to supply water to and discharge water from the evaporation tank and to turn on and turn off the heating unit 42. Suitable controls for this purpose are well-known and form no part of the present invention. Accordingly, description of them is believed to be unnecessary and is omitted. Such controls may if desired be provided with a suitable control panel, for example as at 78 in FIG. 4*a*.

The mats 61 are non-woven, fibrous mats having a high surface area and are effective to deposit preferentially thereon the mineral salts that are created during and as a result of steam generation in the evaporation tank 36, rather than depositing them on other internal surfaces of the evaporation tank. It is presently preferred to use mats made of thermally bonded polyester fibers, especially polyethylene terephthalate fibers. A particularly preferred mat material is Filtermat Type P15/500S. available from Freudenberg Nonwovens L.P., Viledon Filter Division, of Chelmsford, MA. Filtermat Type P15/500S has an ASHRAE arrestance of 92%, an initial pressure loss at 300 fpm of 0.20 inches water gauge, a final pressure loss of 0.8 inches water gauge and a nominal depth or thickness of $\frac{3}{4}$ inch.

Figure 6:
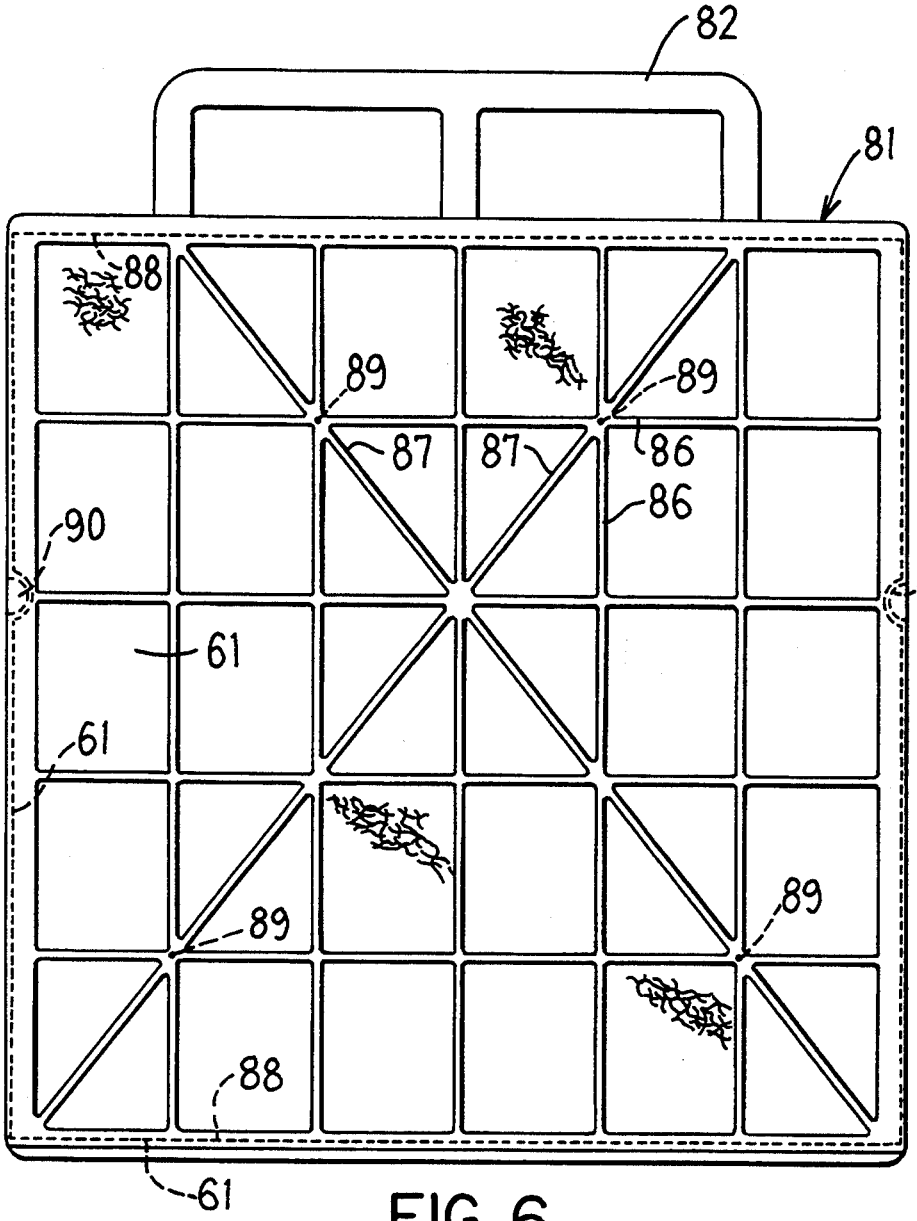
FIG. 6 is a front view of a mat and its supporting framework.
Figure 7:
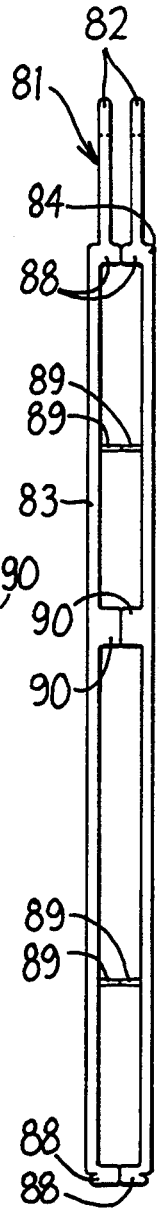
FIG. 7 is a side elevational view of the supporting framework of FIG. 6.
Figure 6A:
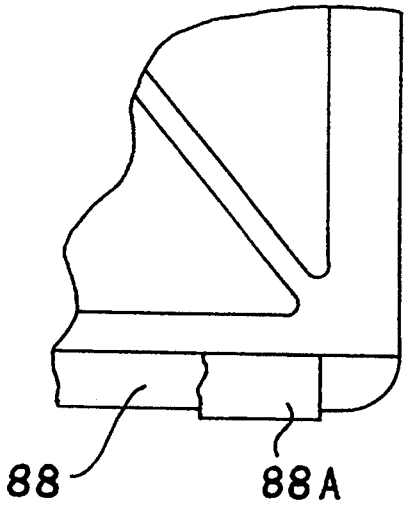
FIG. 6A is an enlarged fragment of FIG. 6 showing one end of an elongate metal strip on the bottom of the framework.
Figure 7A:
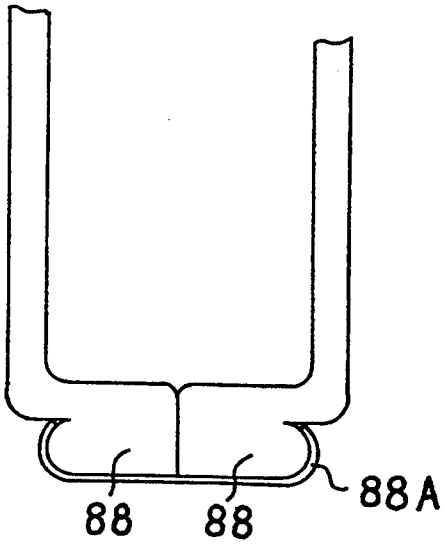
FIG. 7A is an enlarged fragment of FIG. 7 showing the FIG. 6A strip in end view.
Figure 8:
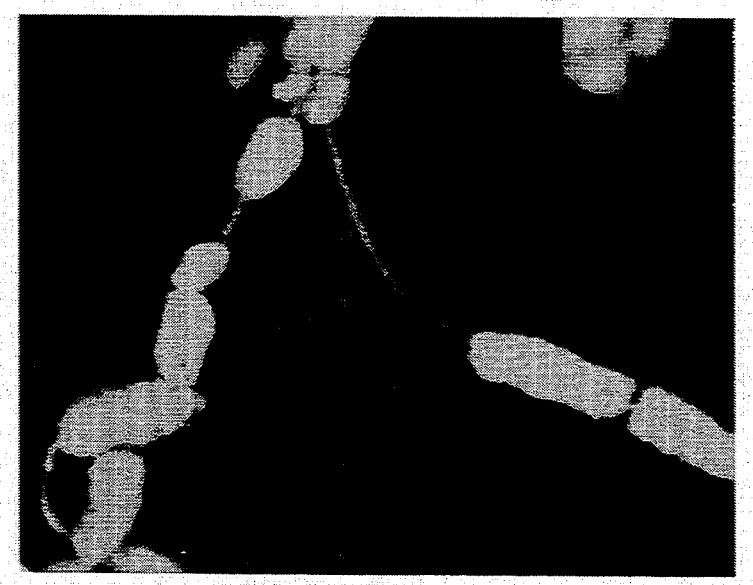
FIG. 8 is a photograph, at 60× magnification, of two fibers of a mat after 980 hours of use in a steam generator, portions of the mineral deposits on the fiber having been removed in order to reveal the underlying fiber.
Figure 9:
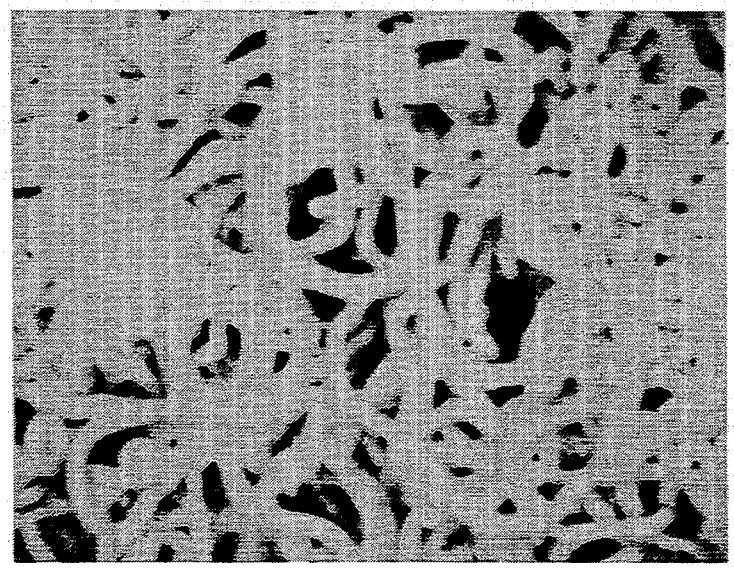
FIG. 9 is a photograph, at 10× magnifications, of a portion of a mat after 980 hours of use in a steam generator.

In the preferred embodiment shown, the mats 61 (FIG. 6 and 7) are each disposed within a surrounding framework 81 having a handle 82 attached to its upper edge. The framework 81 is comprised of two sections 83 and 84 which are mirror images of one another. Each section is comprised of walls 86 that form a rectangular grid work, with diagonal braces 87. The sections 83 and 84 have opposed protrusions, for example elongate, top and bottom flanges 88, plug-like side baulks 90 and narrow intermediate pins 89 that abut against each other to provide a space between the grids. The fibrous mat(s) 61 are disposed in the space between the grids 86. Thus, the opposite sides of the mat 61 are supported by the grids 86. The flanges 88 and side baulks 90 border the mat 61 and the pins 89 penetrate the central portion of the mat 61 to fix the mat within the framework 81. The opposed top flanges 88 and side baulks 90 are fixed together, as by adhesive bonding. At least in one embodiment, an elongate, C-section, stainless steel clip 88A (FIGS. 6A and 7A) extends along and fixes together the bottom flanges 88 and protects the framework 81 from excessive heat produced by the adjacent heat source 42. The mat 61 is trapped between the sections 83 and 84 to thus form a unitary plate 61, 81. With the mat 61 installed in the tank 36, the framework 81 engages the opposed channels 64 to reliably support and fixedly locate the mat 61 with respect to the tank walls and adjacent mats 61.

In use, the plates 61, 81 are completely immersed in the water inside the evaporation tank and the mats 61 are effective to remove preferentially the water minerals that form during operation in the manner discussed above. When the collection efficiency of the fibers of the mats 61 diminishes, the drawer 21 can be opened so that the mats 61 can be removed and replaced by fresh mats. From time to time, it may be necessary to remove the entire evaporation tank for cleaning, repair or replacement.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for reducing the amount of minerals deposited on a surface of a steam generator, which surface contacts water containing compounds that will form said mineral deposits during steam generation, the method comprising the steps of: during steam generation, continuously contacting the water in the steam generator with a non-woven, porous mat made of fibers of fiber-forming synthetic resin effective to cause said minerals to deposit on said mat in preference to said surface.

2. A method as claimed in claim 1, in which said surface is a heat exchange surface in said steam generator.

3. A method as claimed in claim 1 in which said mat consists essentially of a flat, sheet-form, spun-bonded fabric made of randomly arranged polyester fibers which are thermally bonded to each other by fusion at the locations where they contact each other.

4. A method as claimed in claim 3 in which the bond-to-bond distances between said locations are from 50 to 100 times the fiber diameter, the fiber diameter is from 0.1 to 45 denier, the fibers are from about 1.2 to 200 cm long and the fabric weight is from 10 to 800 g/m$^2$.

5. A steam generator, comprising: a housing; a drawer mounted on said housing for movement between a closed position and an open position; an evaporation tank mounted on an inner side of said drawer for movement therewith, said evaporation tank being disposed inside said housing when said drawer is in said closed position and the upper end of said evaporation tank being disposed frontwardly of said housing when said drawer is in said open position, said tank being adapted to contain a supply of water which is to be heated; at least one mat removably disposed in said tank, said mat being a non-woven, porous mat made of fibers of fiberforming synthetic resin so as to cause mineral particles created during heating of the water to form on said mat in preference to other surfaces of said tank.

6. A steam generator, especially for a humidification system, comprising: an upright housing defining a hollow enclosure, said housing having a front wall having a large opening therethrough; a tilt-out drawer disposed in and substantially filling said opening; pivot means hingedly connecting a lower edge of said tilt-out drawer to said housing adjacent to a lower edge of said opening so that said drawer can be tilted outwardly relative to said front wall of said housing to an upwardly and outwardly inclined position; an evaporation tank mounted on an inner side of said tilt-out drawer for tilting movement therewith, said evaporation tank being disposed inside said housing when said tilt-out drawer is in an upright position closing said opening, the upper end of said water heating tank being disposed frontwardly of said front wall of said housing when said drawer is tilted outwardly, said tank being adapted to contain a supply of water which is to be heated; at least one mat removably disposed in said tank, said mat being a non-woven, porous mat made of fibers of fiber-forming synthetic resin so as to cause mineral particles created during heating of the water to form on said mat in preference to other surfaces of said tank.

7. A steam generator as claimed in claim 6 in which said mat consists essentially of a flat, sheet form, spunbonded fabric made of randomly arranged polyester fibers which are thermally bonded to each other by fusion at the locations where they contact each other.

8. A steam generator as claimed in claim 7 in which the bond-to-bond distances between said locations are from 50 to 100 times the fiber diameter, the fiber diameter is from 0.1 to 45 denier, the fibers are from about 1.2 to 200 cm long and the fabric weight is from 10 to 800 $g/m^2$.

9. A steam generator as claimed in claim 6 in which said tilt-out drawer has a front panel and a base wall extending rearwardly from the lower end of said front panel into said enclosure; guide means on the inner side of said front panel for vertically slidably engaging said evaporation tank so that said evaporation tank can be removed from said drawer by sliding same upwardly when said drawer is in said upwardly and outwardly inclined positions; heating means disposed in the lower end of said evaporation tank; a plurality of said mats disposed in said evaporation tank above said heating means, said mats being mounted in upright, parallel, spaced-apart relationship to each other to define upright flow paths therebetween; guide means on said evaporation tank for supporting said mats for independent, vertical sliding movement relative to said evaporation tank so that said mats can be removed from said evaporation tank, said evaporation tank being open at its upper end; a steam collection dome disposed in said housing above said evaporation tank and sealing means coacting between said evaporation tank and said dome so that a steam-tight seal can be provided between said dome and said tank; a steam discharge extending from said dome outwardly from said housing; and a drain at the bottom of said evaporation tank.

* * * * *